US010122095B2

(12) United States Patent
Kojima et al.

(10) Patent No.: US 10,122,095 B2
(45) Date of Patent: Nov. 6, 2018

(54) CRIMP TERMINAL, CONNECTING STRUCTURE, MANUFACTURING METHOD OF THE CRIMP TERMINAL, AND LASER WELDING METHOD

(71) Applicants: FURUKAWA ELECTRIC CO., LTD., Tokyo (JP); FURUKAWA AUTOMOTIVE SYSTEMS INC., Inukami-gun (JP)

(72) Inventors: Shinya Kojima, Tokyo (JP); Saburo Yagi, Tokyo (JP); Takashi Shigematsu, Tokyo (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

(21) Appl. No.: 15/433,875

(22) Filed: Feb. 15, 2017

(65) Prior Publication Data

US 2017/0162953 A1 Jun. 8, 2017

Related U.S. Application Data

(63) Continuation of application No. PCT/JP2015/073631, filed on Aug. 21, 2015.

(30) Foreign Application Priority Data

Aug. 22, 2014 (JP) ..... 2014-169920
Mar. 6, 2015 (JP) ..... 2015-044604

(51) Int. Cl.
*H01R 43/16* (2006.01)
*H01R 4/18* (2006.01)

(52) U.S. Cl.
CPC ..... *H01R 4/183* (2013.01); *H01R 43/16* (2013.01)

(58) Field of Classification Search
CPC ..... H01R 4/185; H01R 13/506; H01R 4/18; H01R 13/533; H01R 43/048; H01R 4/20;
(Continued)

(56) References Cited

U.S. PATENT DOCUMENTS 6,045,944 A 4/2000 Okada et al.
9,118,123 B2 * 8/2015 Kawamura ..... H01R 4/187
(Continued)

FOREIGN PATENT DOCUMENTS

CN 1994654 A 7/2007
JP 11-111246 4/1999
(Continued)

OTHER PUBLICATIONS

English translation of the International Preliminary Report on Patentability dated Feb. 28, 2017 in PCT/JP2015/073631 filed Aug. 21, 2015.
(Continued)

*Primary Examiner* — Truc Nguyen
(74) *Attorney, Agent, or Firm* — Oblon, McClelland, Maier & Neustadt, L.L.P.

(57) ABSTRACT

A crimp terminal includes a crimp portion formed in a tubular shape with an electrically conductive the substrate and configured to crimp join with an electric wire, and a sealing portion formed at one end of the crimp portion and seals against an electric wire to be crimp joined to the crimp portion. At the sealing portion, the substrate is bent and lapped and continuously joined from one end portion to another end portion of this overlapped portion. One end of
(Continued)

a joining trajectory is at a position that is deviated on a side opposite of the crimp portion with respect to the sealing portion.

10 Claims, 12 Drawing Sheets

(58) Field of Classification Search
CPC .. H01R 11/12; H01R 13/426; H01R 13/4361; H01R 13/58; H01R 2107/00; H01R 2201/26; H01R 24/40; H01R 4/34; H01R 9/0518
See application file for complete search history.

(56) References Cited

U.S. PATENT DOCUMENTS

| | | | | |
|---|---|---|---|---|
| 9,236,667 | B2 * | 1/2016 | Shimizu | H01R 4/183 |
| 9,287,634 | B2 * | 3/2016 | Kawamura | H01R 4/10 |
| 9,525,215 | B2 * | 12/2016 | Kawamura | H01R 4/187 |
| 9,543,689 | B2 * | 1/2017 | Sato | H01R 4/184 |
| 9,640,877 | B2 * | 5/2017 | Aoki | H01R 4/185 |
| 2010/0035482 | A1 * | 2/2010 | Nakamura | H01R 4/185 439/775 |
| 2012/0160815 | A1 | 6/2012 | Hayashimoto et al. | |
| 2012/0325552 | A1 | 12/2012 | Sakura | |
| 2012/0329341 | A1 * | 12/2012 | Morikawa | H01R 4/185 439/866 |
| 2013/0095708 | A1 * | 4/2013 | Mitose | H01R 4/184 439/878 |
| 2013/0130569 | A1 * | 5/2013 | Sato | H01R 4/206 439/882 |
| 2013/0220698 | A1 | 8/2013 | Takayama et al. | |
| 2014/0106628 | A1 * | 4/2014 | Sato | H01R 4/188 439/877 |
| 2014/0273667 | A1 * | 9/2014 | Tachibana | H01R 43/048 439/877 |
| 2014/0377991 | A1 | 12/2014 | Kawamura et al. | |
| 2015/0126078 | A1 | 5/2015 | Kawamura et al. | |
| 2016/0126642 | A1 | 5/2016 | Tonoike et al. | |

FOREIGN PATENT DOCUMENTS

| | | | |
|---|---|---|---|
| JP | 2004-207172 | | 7/2004 |
| JP | 2005-106527 | | 4/2005 |
| JP | 4326797 | B2 | 6/2009 |
| JP | 2011-222243 | | 11/2011 |
| JP | 2012-84471 | | 4/2012 |
| JP | 2012-135794 | | 7/2012 |
| JP | 5535408 | | 7/2014 |
| JP | 5567237 | | 8/2014 |
| WO | WO 20121050236 | A1 | 4/2012 |
| WO | WO 2014/010605 | A1 | 1/2014 |
| WO | WO 2014/014105 | A1 | 1/2014 |
| WO | WO 2014/208108 | A1 | 12/2014 |

OTHER PUBLICATIONS

English translation of the Written Opinion of the International Searching Authority dated Nov. 17, 2015 in PCT/JP2015/073631 filed Aug. 21, 2015.
Office Action dated Mar. 12, 2018 in European Patent Application No. 15833359.1, 4 pages.
Office Acton dated Mar. 30, 2018 in Korean Patent Application No. 10-2017-7000497 (with English language translation) 12 pages.
International Search Report dated Nov. 17, 2015 in PCT/JP2015/073631, filed on Aug. 21, 2015 ( with English Translation).
Written Opinion dated Nov. 17, 2015 in PCT/JP2015/073631, filed on Aug. 21, 2015.
Chinese Office Action dated Jun. 28, 2016, issued in Chinese Patent Application No. 201580037267.0 (with Engiish translation).
European Search Report dated Jul. 4, 2018, issued in European Patent Application No. 15833359.1.
Extended European Search Report dated Aug. 30, 2018, issued in European Patent Application No. 18172679.5.

* cited by examiner

CRIMP TERMINAL, CONNECTING STRUCTURE, MANUFACTURING METHOD OF THE CRIMP TERMINAL, AND LASER WELDING METHOD

CROSS REFERENCE TO RELATED APPLICATIONS

This is a continuation application of International Patent Application No. PCT/JP2015/073631 filed Aug. 21, 2015, which claims the benefit of Japanese Patent Application Nos. 2014-169920 and 2015-044604, filed Aug. 22, 2014 and Mar. 6, 2015, respectively, the full contents of all of which are hereby incorporated by reference in their entirety.

BACKGROUND

Technical Field

The present disclosure relates to a crimp terminal for electrical connection with other components, a connecting structure using the crimp terminal, a method of manufacturing the crimp terminal and a laser welding method of the crimp terminal.

Background

In the field of vehicles, in view of improving fuel consumption, there is a need for lightweighting of various components constituting automobiles. Particularly, a wire harness used in automobiles is a component having a considerable weight in an automobile and thus, for lightweighting, there have been efforts to change a material of a conductor (core wire) of an electric wire used in the wire harness from copper to one of aluminum and an aluminum alloy. Normally, a crimp terminal made of one of copper and a copper alloy is used for a terminal connected to a leading end portion of an aluminum or aluminum alloy wire. Accordingly, since there is a possibility that exposed aluminum produces dissimilar metal corrosion and the conductor becomes defective at a connecting portion between the conductor and the terminal that are made of the aforementioned materials, it is necessary to take measures such as to shield the aluminum conductor from the outside world.

To this end, it is known to mold an entire crimp portion with a resin (e.g., see Japanese Laid-Open Patent Publication No. 2011-222243). However, this results in a bulky connector since the size of a connector housing needs to be larger because of a bulky mold portion, and thus a wire harness as a whole cannot be miniaturized or have a higher density. With a molding method, since individual crimp portion is processed after the crimping of an electric wire, there is a problem that manufacturing processes of a wire harness may largely increase or become cumbersome.

In order to solve such a problem, there are proposed techniques such as a technique in which a metal cap is placed to cover the electric wire conductor and thereafter crimped to thereby bring an aluminum conductor into a sealed state and a technique in which a crimp terminal and a metal cap are not provided as separate components but rather an electric wire is covered with a part of a strip of terminal to provide a sealed state (e.g., see Japanese Laid-Open Patent Publication Nos. 2004-207172 and 2012-84471, and International Publication WO2014/010605).

Here, an electric wire including an aluminum conductor is crimped in a covered state, a method in which a part of a substrate (metal plate) stamped to correspond to a shape of the crimp terminal is bent into a cylindrical shape, and a butted portion or a lapped portion at both ends thereof is welded by a laser provides both improved formability and productivity.

However, when laser welding the overlapped portion to make an electric wire into a sealed state, there is a possibility that a keyhole 101 could be formed at the end of welding as shown in FIG. 10. As a result, there was a drawback that the welding of the overlapped portion 102 may become incomplete, and a possibility that an electric wire cannot be sealed increases.

Accordingly, the present disclosure is related to providing a crimp terminal that can accurately perform the welding of the overlapped portion without lowering the quality of the crimp terminal, a connecting structure using the crimp terminal, a method of manufacturing the crimp terminal and a laser welding method of the crimp terminal.

SUMMARY

According to an aspect of the present disclosure, a crimp terminal includes a crimp portion formed in a tubular shape with an electrically conductive the substrate and configured to crimp join with an electric wire, and a sealing portion formed at one end of the crimp portion and seals against an electric wire to be crimp joined to the crimp portion, and at the sealing portion, the substrate is bent and lapped and continuously joined from one end portion to another end portion of the overlapped portion, and one end of a joining trajectory is at a position that is deviated on a side opposite of the crimp portion with respect to the sealing portion.

Further, it is preferable that the sealing portion has two joining trajectories, a first joining trajectory is formed continuously from the one end portion of the overlapped portion to a position between the one end and the other end portion, one end thereof being at a position that is deviated on a side opposite of the crimp portion with respect to the sealing portion, and a second joining trajectory overlying the first joining trajectory continuously from the other end portion of the overlapped portion, one end thereof being at a position that is deviated on a side opposite of the crimp portion with respect to the sealing portion.

Further, it is preferable that the sealing portion has two joining trajectories, a first joining trajectory is formed continuously from the one end portion of the overlapped portion to a position between the one end and the other end portion, a second joining trajectory overlying the first joining trajectory continuously from the other end portion of the overlapped portion, one end thereof being at a position that is deviated on a side opposite of the crimp portion with respect to the sealing portion.

Further, it is preferable that the joining trajectory is at a position where one end portion is bent back on the one end portion side continuously from the other end portion of the overlapped portion.

According to another aspect of the present disclosure, a crimp terminal includes a crimp portion formed in a tubular shape with an electrically conductive the substrate and configured to crimp join with an electric wire, and a sealing portion formed at one end of the crimp portion and seals against an electric wire to be crimp joined to the crimp portion, at the sealing portion, an overlapped portion at which the substrate is bent and lapped is joined, a joining trajectory is formed at a distance less than from one end and another end of the overlapped portion to a sheet thickness of the substrate, one end of a joining trajectory is at a position that is deviated on a side opposite of the crimp portion with respect to the sealing portion.

Further, it is preferable that a joining width of one end portion of the joining trajectory is smaller than a joining width of the joining trajectory at the sealing portion.

Further, it is preferable that a part of the joining trajectory at a position that is deviated on a side opposite of the crimp portion with respect to the sealing portion is smaller than a joining width of another part of the joining trajectory.

The present disclosure is a connecting structure wherein the crimp terminal and the electric wire are connected at a crimp portion of the aforementioned crimp terminal.

The present disclosure is a method of manufacturing a crimp terminal, the method including stamping an electrically conductive the substrate to match a shape of the crimp terminal, forming a crimp portion having a tubular shape configured to crimp join with an electric wire by bending the stamped the substrate and butting end portions of the substrate with each other and joining the butted portion, and forming a sealing portion configured to seal against an electric wire to be crimp joined to the crimp portion, by bending the stamped the substrate and lapping end portions of the substrate and continuously joining the overlapped portion from one end portion to another end portion, the joining of the overlapped portion being terminated at a position that is deviated on a side opposite of the crimp portion with respect to the sealing portion.

Further, it is preferable to include forming a first joining trajectory by joining continuously from the one end portion of the overlapped portion to a position between the one end and the other end portion and terminating at a position that is deviated on a side opposite of the crimp portion with respect to the sealing portion, and forming a second joining trajectory by overlaying on the first joining trajectory continuously from the other end portion of the overlapped portion and terminating at a position that is deviated on a side opposite of the crimp portion with respect to the sealing portion.

Further, it is preferable to include forming a first joining trajectory by joining continuously from the one end portion of the overlapped portion to a position between the one end and the other end portion, and forming a second joining trajectory by overlaying on the first joining trajectory continuously from the other end portion of the overlapped portion and terminating at a position that is deviated on a side opposite of the crimp portion with respect to the sealing portion.

Further, it is preferable to include joining continuously from the one end portion of the overlapped portion to the other end portion, and terminating at a position where one end portion is bent back on the one end portion side continuously from on the other end portion of the overlapped portion.

The present disclosure is a method of manufacturing a crimp terminal, the method including stamping an electrically conductive the substrate to match a shape of the crimp terminal, forming a crimp portion having a tubular shape configured to crimp join with an electric wire by bending the stamped the substrate and butting end portions of the substrate with each other and joining the butted portion, and forming a sealing portion configured to seal against an electric wire to be crimp joined to the crimp portion, by bending the stamped the substrate and lapping end portions of the substrate and joining the overlapped portion at a distance less than from one end and another end of the overlapped portion to a sheet thickness of the substrate, the joining of the overlapped portion being terminated at a position that is deviated on a side opposite of the crimp portion with respect to the sealing portion.

Further, it is preferable that the joining of the overlapped portion is performed by laser welding, and a laser output power for welding one end portion of the joining trajectory is lower than a laser output power for welding the sealing portion.

Further, it is preferable that a laser output power for welding a part at a position that is deviated on a side opposite of the crimp portion with respect to the sealing portion on the joining trajectory is lower than a laser output power for welding another part of the joining trajectory.

Further, it is preferable that an extending direction of the joining trajectory of the butted portion and an extending direction of the joining trajectory of the sealing portion are made to intersect.

The present disclosure is a laser welding method including welding a target welding region, which requires welding, by a laser continuously from one end portion to another end portion of the target welding region, the welding with the laser being terminated a position that is deviated from the target welding region.

Further, it is preferable that a laser output power for welding one end portion of the target welding region is lowered.

Further, it is preferable that the laser is a fiber laser.

The present disclosure is a crimp terminal including a crimp portion formed in a tubular shape with an electrically conductive the substrate and configured to crimp join with an electric wire, and a sealing portion formed at one end of the crimp portion and seals against an electric wire to be crimp joined to the crimp portion, at the sealing portion, the substrate is bent and lapped and continuously joined by a laser from one end portion to another end portion of the overlapped portion, a terminal end of a welding trajectory by the laser is at a position that is deviated on a side opposite of the crimp portion with respect to the sealing portion.

According to the present disclosure, an overlapped portion can be sealed without lowering the quality of a crimp terminal.

DETAILED DESCRIPTION

Preferred embodiments of the present disclosure will be described with reference to the accompanying drawings. Note that an embodiment below is an exemplary embodiment, and various embodiments are possible within a scope of the present disclosure.

First Embodiment

<Crimp Terminal>

Figure 1:
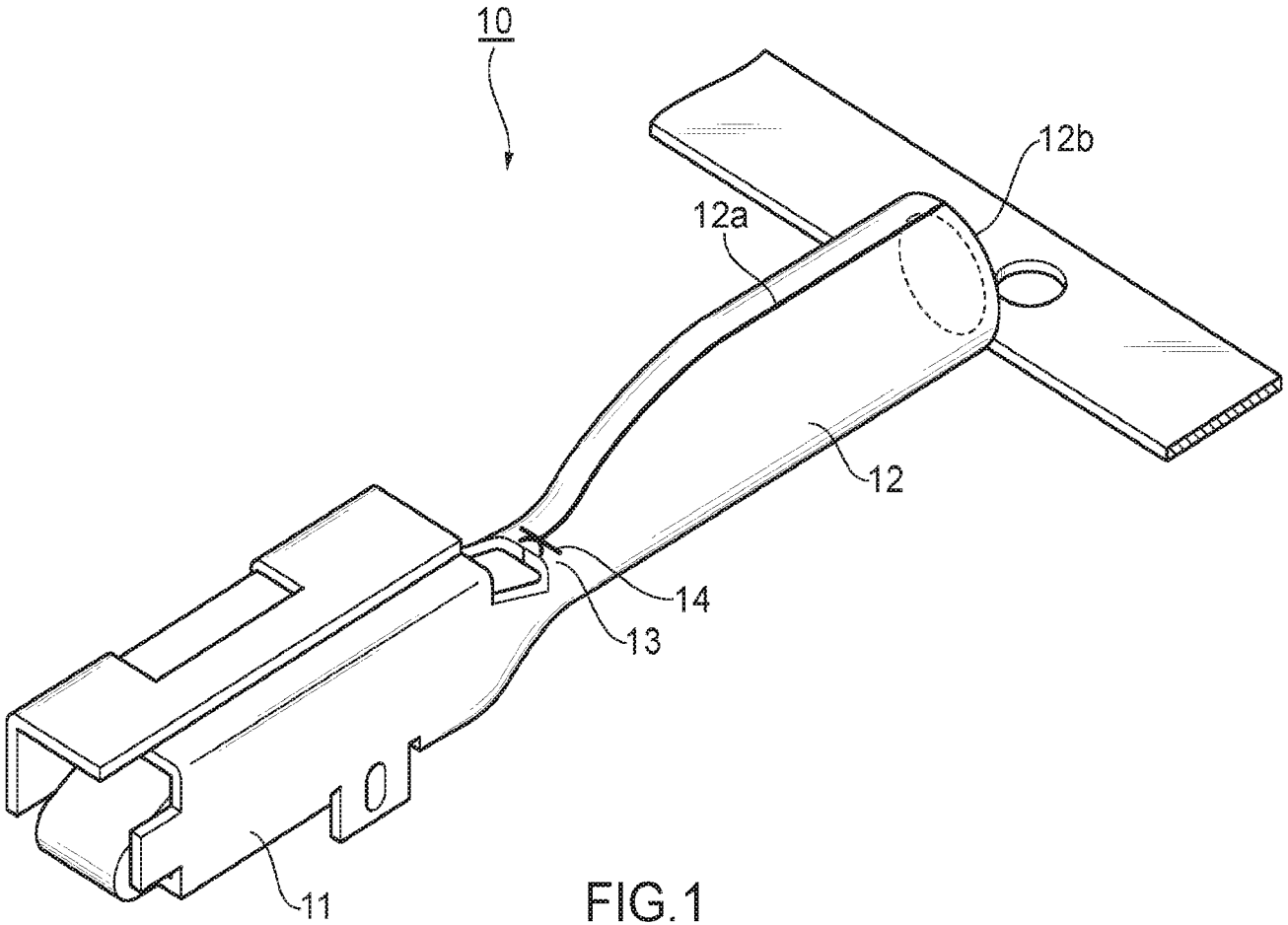
FIG. 1 is a perspective view showing a crimp terminal of the present disclosure.
Figure 2:
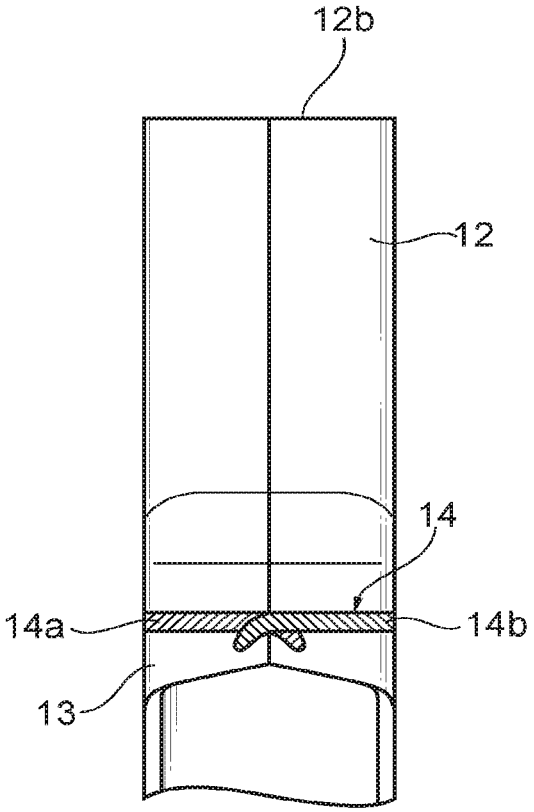
FIG. 2 is a plan view showing a sealing portion of a crimp terminal according to a first embodiment the present disclosure.

As shown in FIGS. 1 and 2, a crimp terminal 10 is formed of a substrate of a metal material (copper, aluminum, steel or alloys primarily composed thereof, etc.) to provide electric conductivity and strength. In order to ensure various kinds of characteristics required for the crimp terminal 10, a part or all of the crimp terminal 10 may undergo, for example, tin plating, silver plating, and the like.

The crimp terminal 10 includes a connector portion 11, a crimp portion 12 and an overlapped portion 13. The connector portion 11, the crimp portion 12 and the overlapped portion 13 are formed integrally with a single substrate.

(Connector Portion)

The connector portion 11 is formed in a box shape by bending the substrate. The connector portion 11 in FIG. 1 is shown as an exemplary female terminal whereto an insertion tab (not shown) of a male terminal or the like is inserted, but the shapes of details of the connector portion 11 is not particularly limited. In other words, as another embodiment, for example, it can be formed by providing an insertion tab of a male terminal in place of a female-type connector portion 11.

(Crimp Portion)

The crimp portion 12 is a portion where an end portion of a coated wire is crimp joined. The crimp portion 12 is formed in a cylindrical shape by bending a punched sheet substrate such that end portions of the substrate are butted to each other and welding a butted portion 12*a* by sweeping the laser. The crimp portion 12 has an opening portion 12*b* (insertion opening) for insertion of a tip end of an electric wire (not shown) at one end (at a right far side in FIG. 1) in a longitudinal direction, and the other end thereof (at a left near side in FIG. 1) in the longitudinal direction is connected to the overlapped portion 13 and closed.

Here, if moisture adheres to a contact between the metal substrate (copper, aluminum, steel, etc.) of the crimp terminal 10 and an aluminum electric wire, a difference in an electromotive force of the two metals leads to corrosion of one of the metals (alloys). Accordingly, the crimp portion 12 is formed in a tubular shape such that moisture or the like does not enter from outside. It is to be noted that, even if the crimp terminal 10 and a core wire of the electric wire are both aluminum, a joining part between them may produce corrosion due to a slight difference in alloy composition. The crimp portion 12 of the crimp terminal 10 has a certain effect on corrosion as long as it has a tubular shape, and thus need not be a cylindrical shape in a longitudinal direction as shown in FIG. 1, but may be of an oval or rectangular tubular shape. Also, a diameter need not be constant, and a radius may vary in a longitudinal direction.

At the crimp portion 12, the metal substrate constituting the crimp portion 12 and the aluminum (aluminum alloy) wire are mechanically crimp joined, and an electrical joint is simultaneously ensured. In the crimp joining, joining is performed by plastic deformation of the substrate and the electric wire (core wire) (crimp joining). Therefore, the crimp portion 12 needs to be designed to have such a thickness to enable crimp joining, but it is not particularly limited, since joining can be performed freely by manual processing, mechanical processing or the like.

(Overlapped Portion)

The overlapped portion 13 is provided between the connector portion 11 and the crimp portion 12, and formed in a flattened shape by being squeezed. The overlapped portion 13 is formed by bending a punched sheet substrate such that end portions of the substrate are butted to each other, and squeezing the butted portion. In other words, the overlapped portion 13 is a portion where end portion sides of the substrate respectively bent inward and adheres to a central portion in a widthwise direction of a surface of the substrate, and the substrate overlaps.

The overlapped portion 13 is sealed in the vicinity of an end portion at a side opposite to an opening portion 12*b* of the crimp portion 12 along a direction orthogonal to a longitudinal direction of the crimp terminal 10. Specifically, the overlapped portion 13 at which the substrate is bent and squeezed is sealed by being joined by laser welding, and a space in the connector portion 11 and a space in the crimp portion 12 are completely separated. A welded region that separates the space in the connector portion 11 and the space in the crimp portion 12 is the sealing portion 14. Thus, a tip portion of a crimp joined electric wire will be sealed in the crimp portion 12.

As shown in FIG. 2, the sealing portion 14 is formed linearly and continuously from one end portion to the other end portion along a widthwise direction, i.e., a direction orthogonal to a joining trajectory of the crimp portion 12 extending in a longitudinal direction of the crimp terminal 10 (hereinafter, a trajectory joined by welding is referred to as a welded trajectory), of the overlapped portion 13.

The sealing portion 14 is formed by performing a welding process twice, and has two weld trajectories 14*a* and 14*b*.

A first weld trajectory 14*a* has a starting end at the one end portion in the widthwise direction of the overlapped portion 13, extends from the one end portion to a central portion in the widthwise direction (a position between the one end portion and the other end portion) of the overlapped portion 13, extends from the central portion in the widthwise portion 13 to a position deviated on a side opposite to the crimp portion 12 with respect to the sealing portion 14 formed in a linear shape, and has a terminating end also at a position deviated on a connector portion 11-side opposite to the crimp portion 12 with respect to the weld trajectory formed in a linear shape that forms the sealing portion 14. As to the first weld trajectory 14*a*, the terminating portion (one end portion) extending to the position deviated on a side opposite to the crimp portion 12 with respect to the sealing portion 14 is formed such that a bead width (joining width) is smaller as compared to another portion (a portion forming the linear sealing portion 14) of the first weld trajectory 14*a*.

A second weld trajectory 14*b* has a starting end at the other end portion in the widthwise direction of the overlapped portion 13, and formed in a linear shape to an end portion of a linear portion of the first weld trajectory 14*a*. The second weld trajectory 14*b*, after overlapping the first weld trajectory 14*a*, extends to a position deviated on a side opposite to the crimp portion 12 with respect to the sealing portion 14 formed in a linear shape, and a terminating end (one end portion) is also at a position deviated on a connector portion 11-side opposite to the crimp portion 12 with respect to the weld trajectory formed in a linear shape that forms the sealing portion 14. As to the second weld trajectory 14*b*, the terminating portion extending to the position deviated on a side opposite to the crimp portion 12 with respect to the sealing portion 14 is formed such that a bead width is smaller as compared to another portion (a portion forming a linear sealing portion 14) of the second weld trajectory 14*b*.

The sealing portion 14 is formed of two weld trajectories 14*a* and 14*b* extending linearly halfway, and terminating ends of the respective weld trajectories 14*a* and 14*b* deviate from the weld trajectories 14*a* and 14*b* towards the connector portion-11 side. It is to be noted that, since both weld trajectories 14*a* and 14*b* are welded to overlap on the sealing portion 14, the welding (sealing) is fully completed.

The sealing portion 14 is completed by carrying out the welding to form the first weld trajectory 14*a*, thereafter carrying out the welding to form the second weld trajectory 14*b*, and then connecting the straight portions of the two weld trajectories 14*a* and 14*b*.

<Wire Harness>

In using a wire harness (connecting structure), a coated wire obtained by coating an aluminum core wire, in which aluminum strands are stranded, with an insulating resin is crimp connected to the crimp terminal 10 with the core wire part being exposed from the insulating resin. The coated wire is connected to the crimp terminal 10 by being crimped with the crimp portion 12 of the crimp terminal 10.

Here, the core wire of the aluminum electric wire may be, for example, an aluminum core wire comprising or consisting of: approximately 0.2 mass % iron (Fe), approximately 0.2 mass % copper (Cu), approximately 0.1 mass % magnesium (Mg), approximately 0.04 mass % silicon (Si), and the balance being aluminum (Al) and inevitable impurities. As other alloy compositions, it is possible to use compositions comprising or consisting of: approximately 1.05 mass % Fe, approximately 0.15 mass % Mg, approximately 0.04 mass % Si, the balance being aluminum (Al) and inevitable impurities; approximately 1.0 mass % Fe, approximately 0.04 mass % Si, the balance being aluminum (Al) and inevitable impurities; and approximately 0.2 mass % Fe, approximately 0.7 mass % Mg, approximately 0.7 mass % Si, the balance being aluminum (Al) and inevitable impurities. These may further contain alloying elements such as Ti, Zr, Sn, and Mn. Using such an aluminum core wire, it is possible to use as a core wire of, for example, 7 to 19 stranded wires of 0.5 to 2.5 sq ($mm^2$). As a cladding material of the core wire, it is possible to use, for example, those having polyolefin as a primary component, such as PE or PP, or those having PVC as a primary component.

In the foregoing, a case in which aluminum is used in an electric wire is described, but it is not be limited thereto, and copper may be used for an electric wire.

<Method of Manufacturing a Crimp Terminal>

Hereinafter, a method of manufacturing the crimp terminal 10 will be described.

Figure 3A:
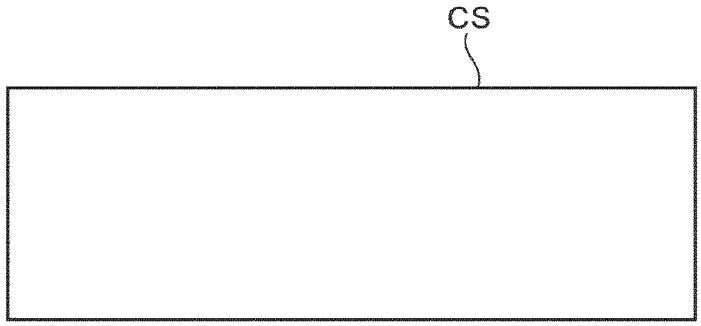
FIGS. 3A to 3D are diagrams illustrating a method of manufacturing a crimp terminal of the present disclosure.
Figure 3B:
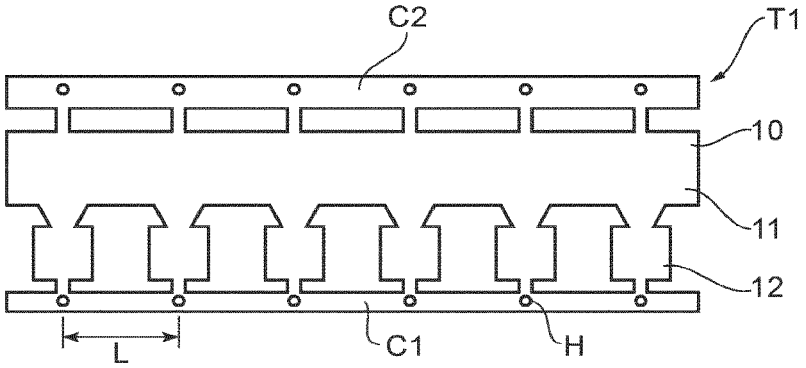

As shown in FIGS. 3A to 3D, the crimp terminal 10 is formed of a sheet strip CS (see FIG. 3A) unwound from a roll. That is to say, a chain terminal T1 shown in FIG. 3B is formed from the sheet strip CS shown in FIG. 3A by applying a stamping process as a primary press. The chain terminal T1 has carrier portions C1 and C2 for conveying the chain terminal T1 in a feeding direction in a pressing machine, not shown, and the carrier portion C1, C2 is provided with a plurality of perforations H at a predetermined pitch L (here, one each corresponding to a position of the crimp terminal 10 as an individual piece) through which pins for positioning are inserted during the conveyance. Between the carrier portions C1 and C2, a portion that forms the crimp portion 12 having a tubular shape of the crimp terminal 10 as an individual piece in a post process and the connector portion 11 having a box shape to serve as a connecting portion with another terminal are formed.

Figure 3C:
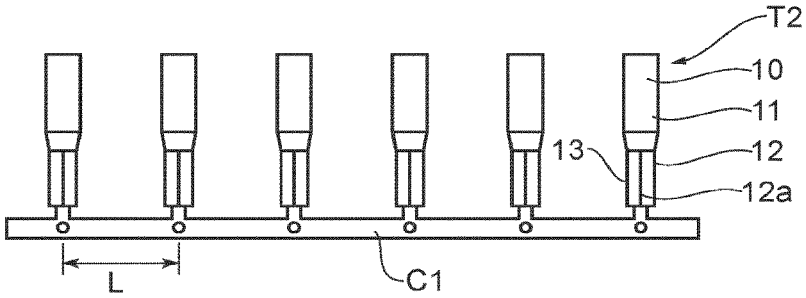
Figure 3D:
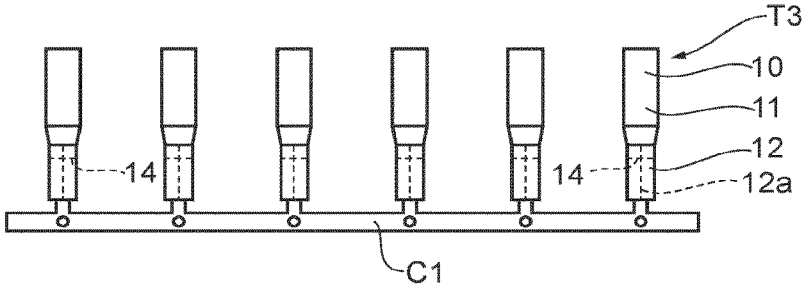

FIG. 3C shows that a chained terminal T2 shown in FIG. 3C is formed by applying a bending process as a secondary pressing. The chained terminal T2 has the carrier portion C2 is removed therefrom, and has the carrier portion C1 only. Also, with a bending process, the crimp portion 12 and the connector portion 11 are formed in a tubular shape (a hollow shape) and a box shape (a boxed shape), respectively. In this state, the crimp portion 12 has a butted portion 12*a* that is formed at a portion bent into a tubular shape.

Figure 4:
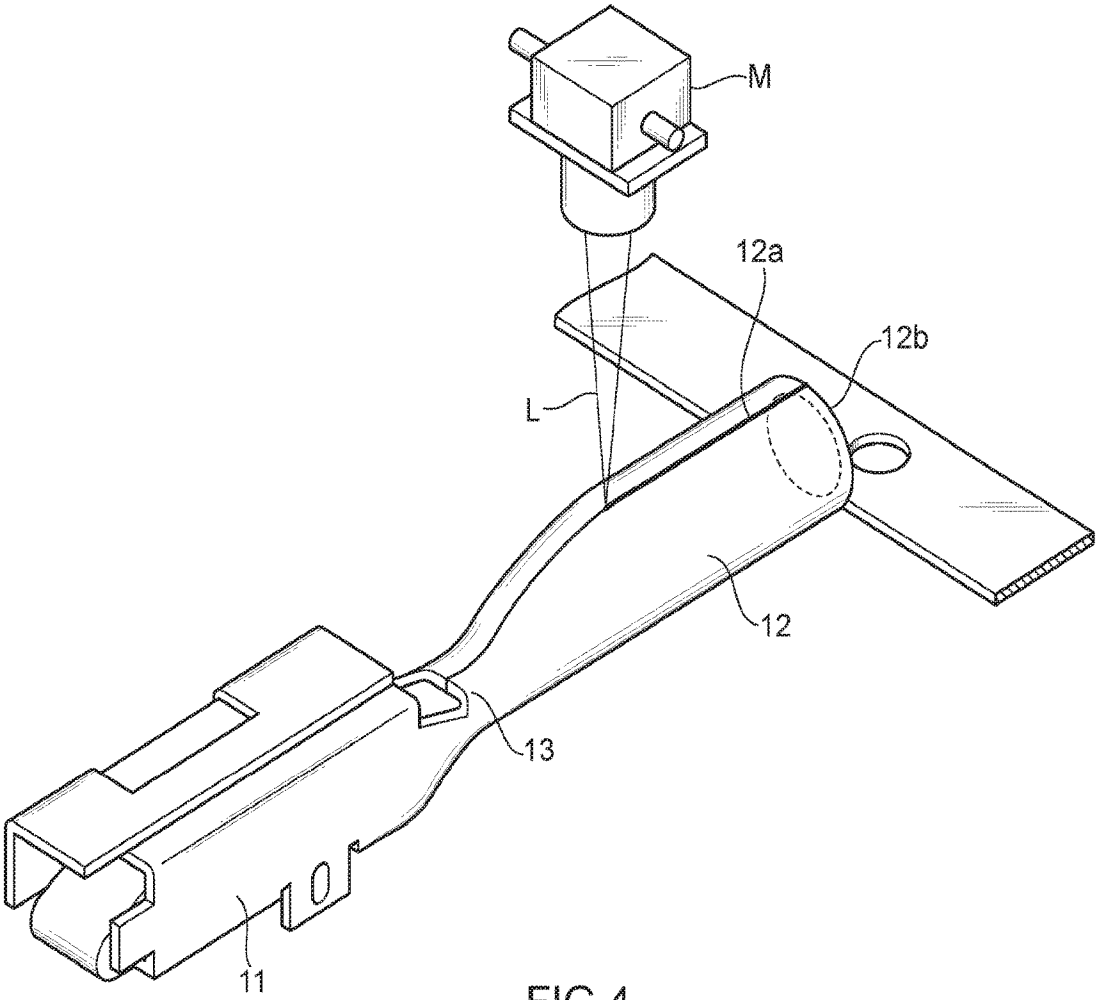
FIG. 4 is a perspective view showing a method of welding a crimp portion of a crimp terminal of the present disclosure.

The butted portion 12*a* is joined by laser welding, and the crimp portion 12 is made into a sealed structure. Specifically, as shown in FIG. 4, the butted portion 12*a* formed towards an axial direction at an upper end portion of the crimp portion 12 which is bent into a tubular shape in the crimp terminal 10 is welded by sweeping laser light L emitted from a laser irradiation device M.

Figure 5:
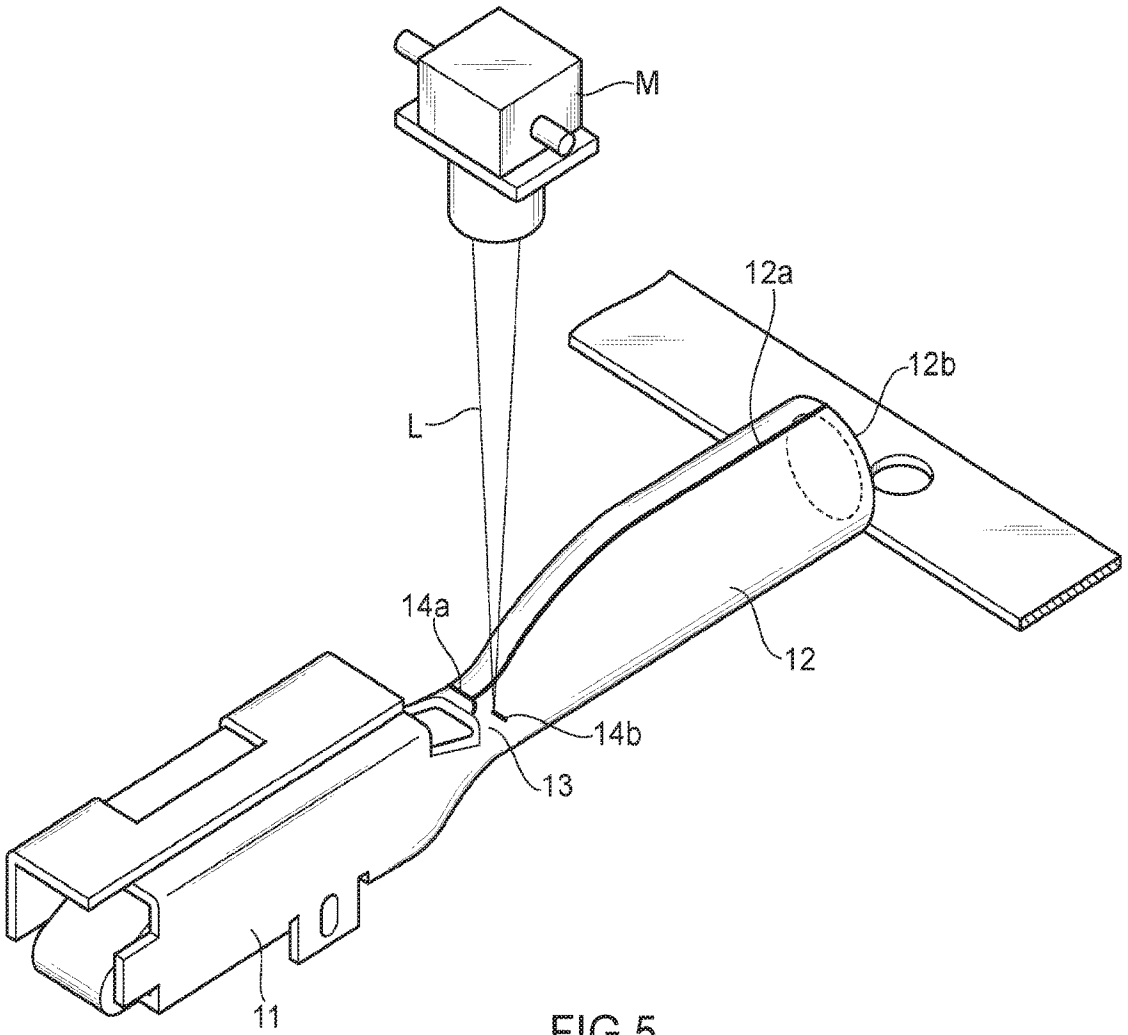
FIG. 5 is a perspective view showing a process of welding an overlapped portion of a crimp terminal of the present disclosure.

Further, a portion to be connected with the connector portion 11 is squeezed to form the overlapped portion 13, and, as shown in FIG. 5, in order to suppress intrusion of water to a conductor portion, the overlapped portion 13 is also welded by sweeping the laser light L emitted from the laser irradiation device M to form a sealing portion 14 (welding target region). Here, the weld trajectory of the sealing portion 14 is formed to extend to a direction orthogonal to the weld trajectory of the crimp portion 12.

Figure 6:
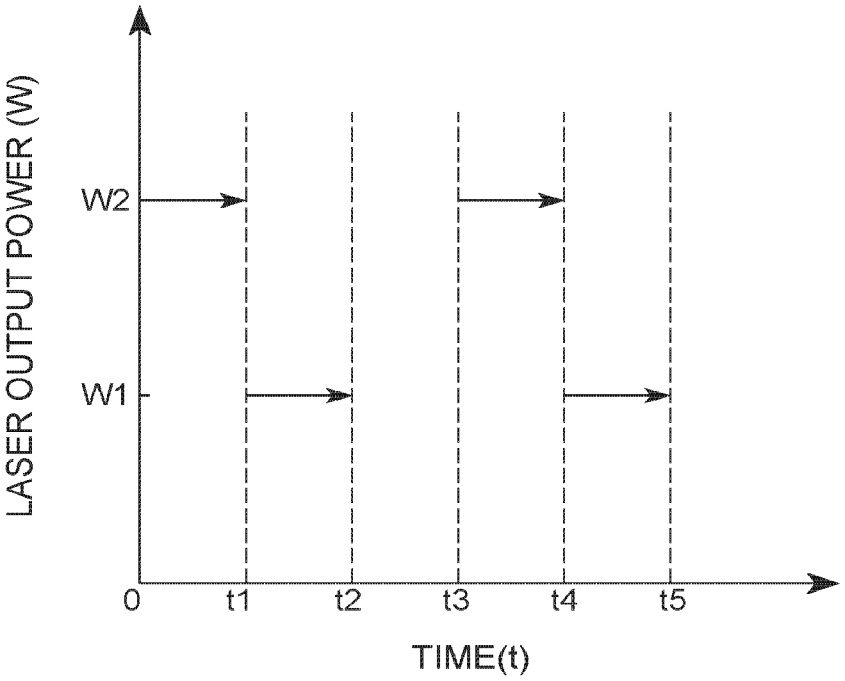
FIG. 6 is a graph showing a transition of laser output power during the welding of the overlapped portion of the crimp terminal of the present disclosure.

Here, in the welding of the sealing portion 14, as shown in FIG. 5, welding is performed by sweeping the laser light L emitted from the laser irradiation device M from the one end portion to the other end portion of the overlapped portion 13 to weld linearly to the vicinity of the center in the widthwise direction of the overlapped portion 13. At this time, as shown in FIG. 6, an output power of the laser is W2, and, after an elapse of time t1 from the start of the welding, the weld trajectory reaches a central part in the widthwise direction of the overlapped portion 13. Thereafter, an output power of the laser is lowered to W1, and the laser light is swept continuously from the sealing portion 14 towards a position deviated on a side opposite to the crimp portion 12, and the welding is terminated after an elapse of time t2 from the start of the welding. Thereby, the first weld trajectory 14*a* is formed.

Then, a laser irradiation position by the laser irradiation device M is moved to the other end portion of the overlapped portion 13. Since the laser light is not emitted during this period, an output power of the laser is zero. Then, after an elapse of time t3 from the start of the welding, the overlapped portion 13 is welded by sweeping the laser light L emitted from the laser irradiation device M from the other end portion to the one end portion, and made to overlap the first weld trajectory 14*a* in the vicinity of the center of the widthwise direction of the overlapped portion 13. At this time, the output power of the laser is W2, and the weld trajectory reaches the central part in the widthwise direction of the overlapped portion 13 after an elapse of time t4 from the start of the welding. Thereafter, the output power of the laser is lowered to W1, and the laser is swept continuously from the sealing portion 14 toward a position deviated on a side opposite the crimp portion 12, and the welding is terminated after elapse of time t5 from the start of the welding. Thereby, the second weld trajectory 14*b* is formed.

Note that a method of lowering the output power of the laser from W2 to W1 can be determined freely, but it is preferable to lower the output power gradually than to lower the output power rapidly.

Here, the laser irradiation device M is an apparatus that irradiates a fiber laser.

The fiber laser has an excellent beam quality and a high light collecting property, and thus can achieve laser welding with a higher energy density in the working region than a conventional laser. Therefore, since a material can be processed with a high-speed, and thus a deep penetration welding with little heat influence and a high aspect ratio can be performed, the sealing portion 14 can be appropriately sealed while suppressing a decrease in the strength or the deformation of the welded part.

The fiber laser may perform irradiation by continuous oscillation, pulsed oscillation, QCW oscillation or pulse controlled continuous oscillation. The fiber laser may be a single mode or a multimode fiber laser.

Note that, with the present disclosure, a laser beam of a YAG laser, a semiconductor laser, a disc laser or the like, or an electron beam may be used in place of fiber laser welding.

With the steps described above, as shown in FIG. 3D, a chain terminal T3 in which the crimp terminals 10 prior to insertion of electric wires are held by the carrier portion C1 is prepared.

Note that, here, an example in which a portion subjected to a bending process of the crimp terminal 10 is butted is used, but according to the present disclosure, joining by laser welding is also possible for a case in which a portion subjected to a bending process is overlapped.

<Operation and Effect>

As described above, when manufacturing the crimp terminal 10, the sealing portion 14 sealed continuously from the one end portion to the other end portion of the overlapped portion 13 is formed by forming the first weld trajectory 14*a* by welding by sweeping the laser from the one end portion in the widthwise direction of the overlapped portion 13, thereafter forming the second weld trajectory 14*b* by welding by sweeping the laser from the other end portion in the widthwise direction of the overlapped portion 13, and causing the two weld trajectories 14*a* and 14*b* to overlap at a position other than both end portions of the overlapped portion 13.

Here, by terminating the ends of the first weld trajectory 14*a* and the second weld trajectory 14*b* at a position on a side opposite to the crimp portion 12, in other words, deviated to a connector 11 side, from the sealing portion 14, even if a keyhole is formed at the end of the first weld trajectory 14*a* and the second weld trajectory 14*b*, there is no influence on the sealing portion 14. Also, even if keyholes are formed at terminating ends of the first weld trajectory 14*a* and the second weld trajectory 14*b*, since it is already sealed from the one end portion to the other end portion by the two weld trajectories 14*a* and 14*b*, there is no adverse effect on the sealing performance.

Further, by achieving the welding by the first and second weld trajectories 14*a* and 14*b*, a heat accumulation by the welding is less likely to occur at the end portion of the overlapped portion 13 in comparison to a case in which the laser is swept from one end portion to the other end portion of the overlapped portion 13, a weld width becomes uniform and a quality of the crimp terminal 10 can be stabilized.

Thus, by employing a welding process as described above, it is possible to prevent the welding width of the both end portions of the sealing portion 14 of the overlapped portion 13 from increasing, and thus the welding of the overlapped portion 13 can be performed accurately without lowering the quality of the crimp terminal.

Second Embodiment

A description is now made of the second embodiment of the crimp terminal of the present disclosure. The second embodiment differs from the first embodiment in a method of welding the overlapped portion, in other words, a method of forming the sealing portion, and therefore, in the following description, the overlapped portion will be described in detail, and features that are the same as those of the first embodiment will be indicated with the same reference signs and the description is omitted. Here, the second embodiment is an embodiment with which a working efficiency of the welding is pursued as compared to the first embodiment.

The overlapped portion 13 is sealed along a direction orthogonal to the longitudinal direction of the crimp terminal 10 in the vicinity of the end portion on a side opposite the opening portion 12*b* of the crimp portion 12. Specifically, the overlapped portion 13 where the substrate is bent and squeezed is sealed by welding by laser welding, and a space in the connector portion 11 and a space in the crimp portion 12 are completely separated. This welded region serves as the sealing portion 14. Thus, the tip portion of the crimp joined electric wire is to be sealed in the crimp portion 12.

Figure 7:
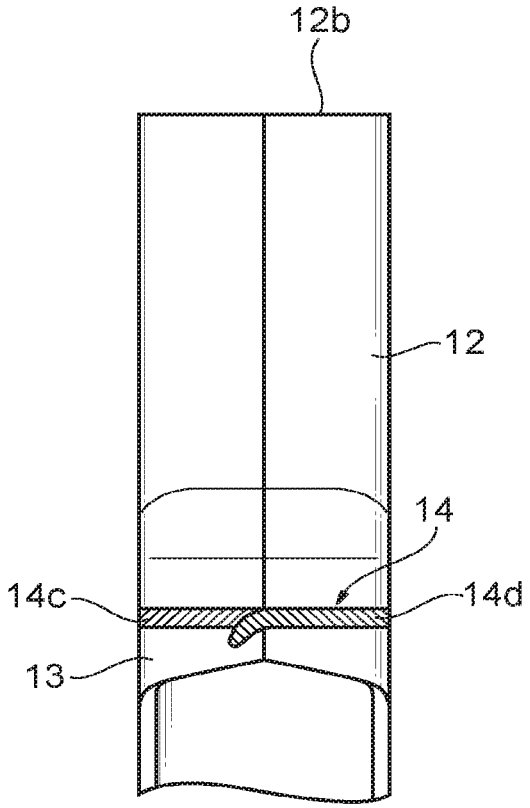
FIG. 7 is a plan view showing a sealing portion of a crimp terminal according to a second embodiment of the present disclosure.

As shown in FIG. 7, the sealing portion 14 is formed continuously and linearly from the one end to the other end portion along a widthwise direction of the overlapped portion 13, namely a direction perpendicular to the weld trajectory (longitudinal direction of the crimp terminal 10) of the crimp portion 12.

The sealing portion 14 is formed by performing the welding process twice, and has two weld trajectories 14*c* and 14*d*.

A first weld trajectory 14*c* has a starting end at the one end portion in the widthwise direction of the overlapped portion 13, a terminating end at a central portion in the widthwise direction of the overlapped portion 13 (a position between the one end portion and the other end portion), and formed continuously and linearly from the starting end and the terminating end.

A second weld trajectory 14*d* has a starting end at the other end portion in the widthwise direction of the overlapped portion 13, and formed linearly to the terminating end of the first weld trajectory 14*c*. The second weld trajectory 14*d* overlaps the terminal end of the first weld trajectory 14*c*, thereafter extends to a position deviated on a side opposite the crimp portion 12 with respect to the sealing portion 14 formed in a linear shape, and the terminating end (one end portion) is also at a position deviated on a side opposite the connector 11 with respect to the linear weld trajectory forming the sealing portion 14. That is to say, the sealing portion 14 is formed of two weld trajectories 14*c* and 14*d* extending linearly, and only the terminal end of the second weld trajectory 14*d* is deviated from the weld trajectory 14*d* and deviated on a side of the connector portion 11. It is to be noted that, since the terminal end of the first weld trajectory 14*c* is welded while being overlapped with the second weld trajectory 14*d*, the welding becomes complete.

As to the sealing portion 14, after the welding has been carried out to form the first weld trajectory 14*c*, welding is performed to form the second weld trajectory 14*d*.

In the welding of the sealing portion 14, the overlapped portion 13 is welded by sweeping the laser light L emitted from the laser irradiation device M from the one end portion to the other end portion, and the welding is terminated near the center. Thereby, the first weld trajectory 14*c* is formed.

Then, the overlapped portion 13 is welded by sweeping the laser light L emitted from the laser irradiation device M from the other portion to the one end portion, and overlapped on the first weld trajectory 14*c* in the vicinity of the center, and thereafter sweeping the laser from the sealing portion 14 towards a position on a side opposite the crimp portion 12, and eventually terminating the welding. Here, like the first embodiment, in the formation of the second weld trajectory 14*d*, when sweeping the laser from the sealing portion 14 towards a position deviated on a side opposite the crimp portion 12, the output power of the laser is lowered to decrease a bead width of the weld trajectory. Thereby, the second weld trajectory 14*d* is formed.

A crimp terminal manufactured by such a welding process has a terminating end of the second weld trajectory 14*d* terminated at a position on a side opposite the crimp portion 12 with respect to the sealed sealing portion 14, in other words, deviated on a connector 11 side, the sealing portion 14 is not affected even if a keyhole is formed at a terminating end of the first weld trajectory 14*c*. Further, even if a keyhole is formed at a terminating end of the second weld trajectory 14*d*, since it is already sealed from the one end portion to the other end portion by the two weld trajectories 14*c* and 14*d*, there is no adverse effect on the sealing capability.

Thus, while ensuring a water-proof property of the sealing portion 14, time required for welding the first weld trajectory 14*c* can be shortened as compared to the first embodiment.

Third Embodiment

Description is now made of the third embodiment of the crimp terminal of the present disclosure. The third embodiment differs from the first embodiment in a method of welding the overlapped portion, in other words, a method of forming the sealing portion, and therefore, in the following description, the overlapped portion will be described in detail, and features that are the same as those of the first embodiment will be indicated with the same reference signs and the description is omitted. Here, the third embodiment is an embodiment with which a working efficiency of the welding is pursued as compared to the first embodiment.

The overlapped portion 13 is sealed along a direction orthogonal to the longitudinal direction of the crimp terminal 10 in the vicinity of an end portion on a side opposite to the opening portion 12*b* of the crimp portion 12. Specifically, the overlapped portion 13 at which the substrate is bent and squeezed is sealed by being joined by laser welding, and a space in the connector portion 11 and a space in the crimp portion 12 are completely separated. This welded region becomes the sealing portion 14. Accordingly, a tip portion of a crimp joined electric wire is sealed in the crimp portion 12.

Figure 8:
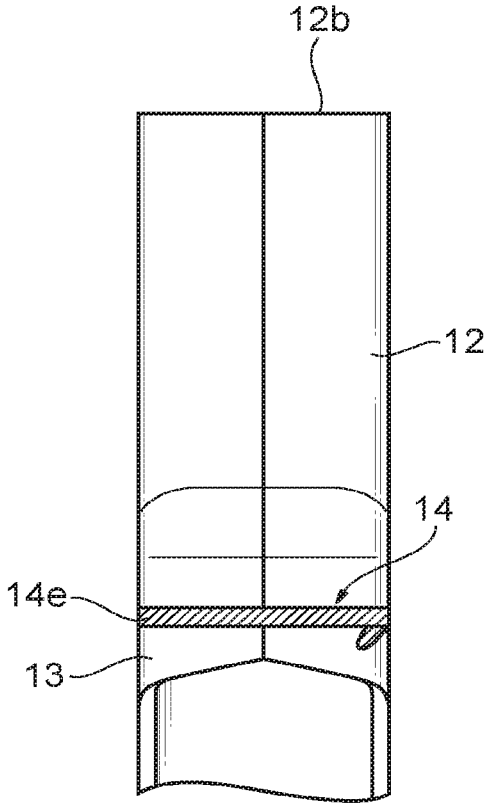
FIG. 8 is a plan view showing a sealing portion of a crimp terminal according to a third embodiment of the present disclosure.

As shown in FIG. 8, the sealing portion 14 is formed continuously and linearly from the one end to the other end portion along a widthwise direction of the overlapped portion 13, namely a direction perpendicular to the weld trajectory (longitudinal direction of the crimp terminal 10) of the crimp portion 12.

The sealing portion 14 has a single weld trajectory 14*e*.

The weld trajectory 14*e* has a starting end at the one end portion in the widthwise direction of the overlapped portion 13, and is formed linearly to the other end portion in the widthwise direction of the overlapped portion 13. After having reached at the other end portion other than overlapped portion, the weld trajectory 14*e* is bent back to the one end side continuously from the other end portion. At this time, the weld trajectory 14*e* is such that a vicinity of a terminating end thereof extends to a position deviated to a side opposite the crimp portion 12 with respect to the sealing portion 14 formed linearly, and a terminating end (one end portion) is also at a position deviated on a connector portion 11 side that is at a side opposite the crimp portion 12 with respect to a weld trajectory forming the sealing portion 14. After being bent back, the weld trajectory 14*e* is welded a little and terminates, and, this position becomes a terminating end. That is to say, the sealing portion 14 is formed of the weld trajectory 14*e* extending linearly, and a terminating end is deviated on the connector portion 11 side with respect to the weld trajectory 14*e*.

In the welding of the sealing portion 14, the overlapped portion 13 is welded by sweeping laser light emitted from the laser irradiation device from the one end portion to the other end portion to form a weld trajectory continuous from the one end portion to the other end portion. Then, the overlapped portion 13 is bent over from the other end portion to the one end portion, and also, the laser is swept from the sealing portion 14 towards a position deviated on a side opposite to the crimp portion 12, and the welding is eventually terminated. Here, like the first embodiment, when sweeping the laser from the sealing portion 14 towards a position deviated on a side opposite the crimp portion 12, the laser output power is lowered and the bead width of the weld trajectory is decreased. Thereby, the weld trajectory 14*e* is formed.

For a crimp terminal manufactured with such a welding method, the welding can be completed with a single laser sweep, and thus time taken for the welding operation is short and has a good efficiency. In other words, since it is not necessary to divide the welding into two times as in the e first embodiment, time take for the welding of the overlapped portion 13 can be significantly reduced, and also, the welding width does not increase since the welding is not terminated at the end portion of the overlapped portion 13. Thus, the overlapped portion 13 can be sealed without reducing a quality of the crimp terminal.

<Variants>

It is to be noted that the present disclosure is not limited to the embodiments described above, and can be freely modified as far as an essential part of the present disclosure is not altered.

Figure 9C:
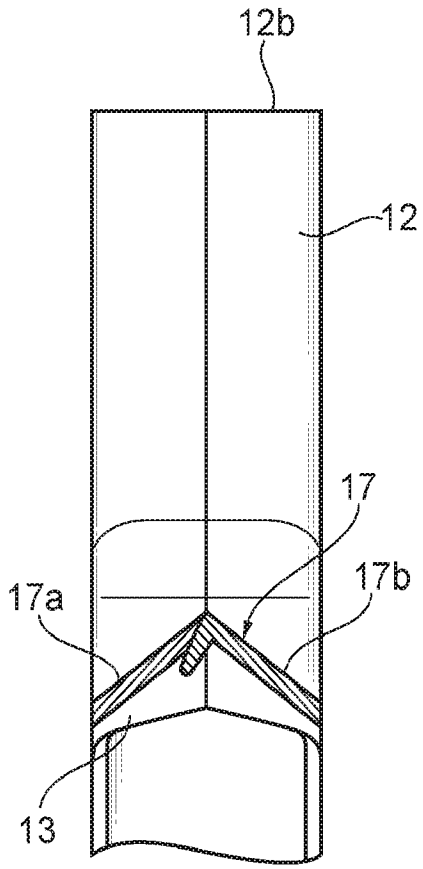
FIGS. 9A to 9C are plan views showing other variants of the sealing portion of the crimp terminal of the present disclosure.
Figure 9B:
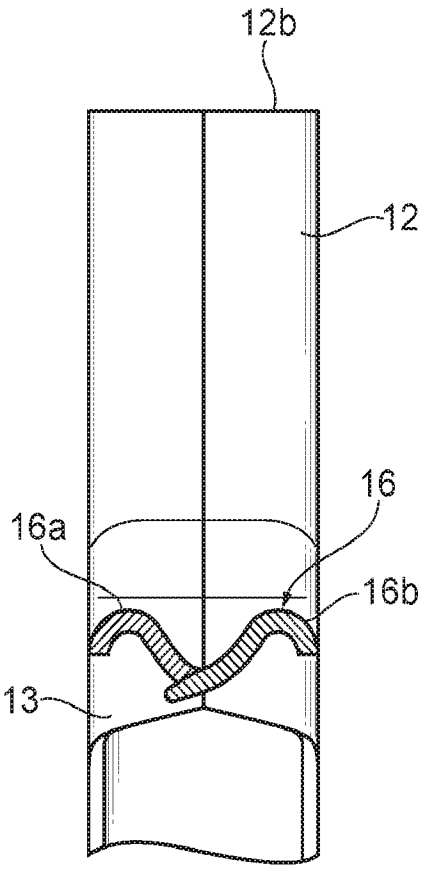
Figure 9A:
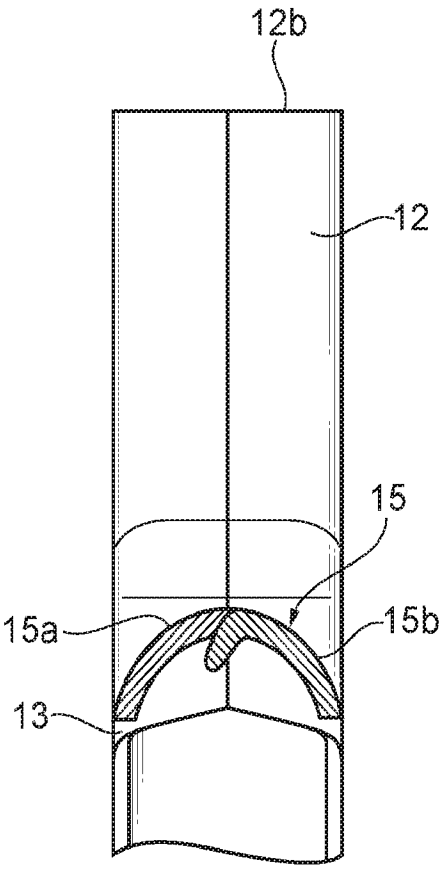

For example, as shown in FIG. 9A, a sealing portion (weld trajectory) 15 at the overlapped portion 13 of the crimp terminal 10 is formed of two arc-shaped weld trajectories 15*a* and 15*b*. In this case, the sealing portion 15 is formed in an arc shape with two weld trajectories 15*a* and 15*b* so as to bulge from right and left end portions (both ends in a widthwise direction orthogonal to an axial direction of the crimp terminal 10) with respect to the axial direction of the crimp terminal 10 towards the opening portion 12*b* side, in other words, towards the crimp portion 12 side. Here, a terminating end of one of the weld trajectories 15*b* (one end portion) is at a position deviated to the connector portion 11 side with respect to the arc-shaped weld trajectory.

Also, as another variant, as shown in FIG. 9B, a sealing portion (weld trajectory) 16 at the overlapped portion 13 of the crimp terminal 10 is formed by two wave-shaped weld trajectories 16*a* and 16*b*. In this case, a plurality of inflection points are formed, and the sealing portion 16 is formed of two curved weld trajectories 16*a* and 16*b* bulging towards both the connector portion 11 side and the crimp portion 12 side. Here, a terminating end (one end portion) of one of the weld trajectories 16*b* is at a position deviated on the connector portion 11 side with respect to the wave-shaped weld trajectory.

Also, as yet another variant, as shown in FIG. 9C, a sealing portion (weld trajectory) 17 at the overlapped portion 13 of the crimp terminal 10 is formed in a V-shape with two linear weld trajectories 17*a* and 17*b*. In this case, the sealing portion 17 is formed from right and left end portions in an axial direction of the crimp terminal 10 and in a V-shape with two weld trajectories 17*a* and 17*b* such that a vertex is towards the opening portion 12*b*, namely on the crimp portion 12 side. Here, a terminating end of one of the weld trajectories 17*b* (one end portion) is at a position deviated on the connector portion 11 side with respect to a V-shaped trajectory.

Figure 10C:
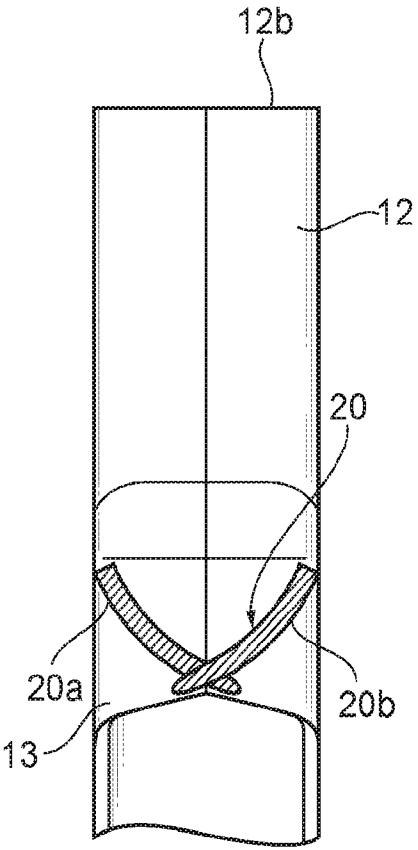
FIGS. 10A to 10C are plan views showing other variants of the sealing portion of the crimp terminal of the present disclosure.
Figure 10B:
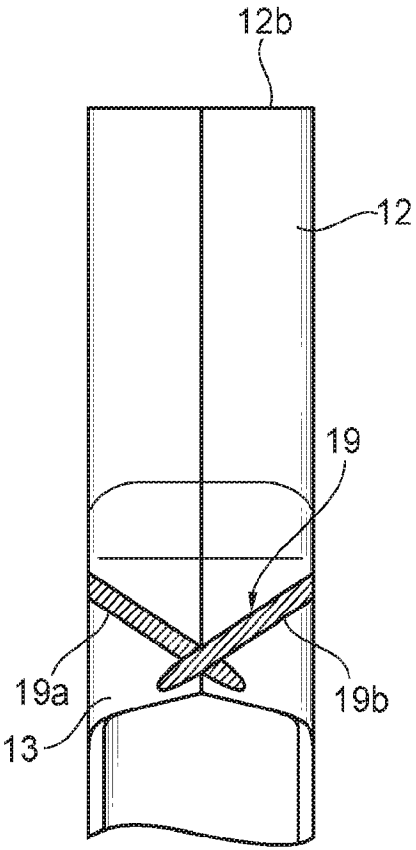
Figure 10A:
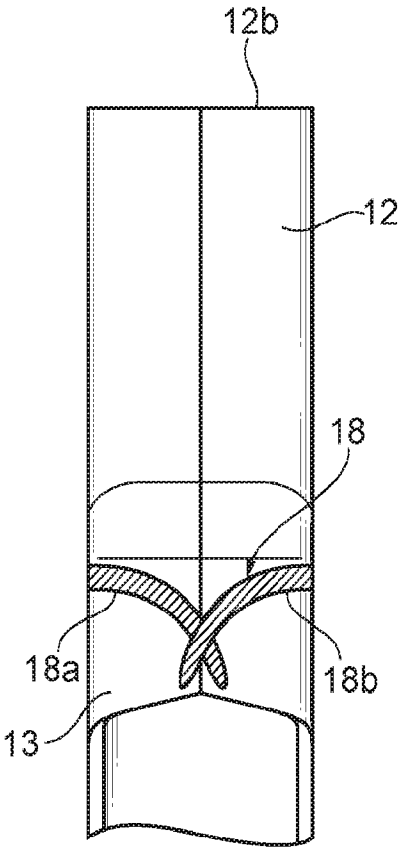

Also, as another variant, as shown in FIG. 10A, the sealing portion (weld trajectory) 18 at the overlapped portion 13 of the crimp terminal 10 is formed by two arc-shaped curved weld trajectories 18*a* and 18*b*. In this case, the sealing portion 18 is formed with two arc-shaped curved weld trajectories 18*a* and 18*b* from right and left end portions with respect to an axial direction of the crimp terminal 10 towards the connector portion 11 side and intersect at a central portion in a widthwise direction of the crimp terminal 10. At this time, the two weld trajectories 18*a* and 18*b* are formed to bulge towards the opening portion 12*b* side, namely the crimp portion 12 side, but the weld trajectory is not formed on the crimp portion 12 side from the right and left end portions with respect to an axial direction of the crimp terminal 10 where the welding starts.

A terminal end (one end portion) of each of the weld trajectories 18*a* and 18*b* is deviated towards the connector portion 11 side with respect to the sealing portion 18 formed of the weld trajectories 18*a* and 18*b*.

In this manner, by forming the sealing portion (weld trajectory) 18 with two arc-shaped curved weld trajectories 18*a* and 18*b*, the laser only needs to be swept in an arc shape, and when changing a sweep direction of the laser during the welding as shown in FIG. 2, the sweeping of the laser does not stop momentarily, and thus a keyhole is less likely to be formed, and weld quality is less likely to decrease.

Also, as another variant, as shown in FIG. 10B, the sealing portion (weld trajectory) 19 in the overlapped portion 13 of the crimp terminal 10 is formed with two linear weld trajectories 19*a* and 19*b*. In this case, the sealing portion 19 is formed with two linear weld trajectories 19*a* and 19*b* from right and left end portions with respect to an axial direction of the crimp terminal 10 towards the connector portion 11 side and intersect at a central portion in a widthwise direction of the crimp terminal 10.

A terminal end (one end portion) of each of the weld trajectories 19*a* and 19*b* is deviated towards the connector portion 11 side with respect to the sealing portion 19 formed of the weld trajectories 19*a* and 19*b*.

In this case, an effect similar to that of the sealing portion 18 of FIG. 10A can also be achieved.

Further, as another variant, as shown in FIG. 10C, the sealing portion (weld trajectory) 20 at the overlapped portion 13 of the crimp terminal 10 is formed by two arc-shaped curved weld trajectories 20*a* and 20*b*. In this case, the sealing portion 20 is formed with two arc-shaped curved weld trajectories 20*a* and 20*b* from right and left end portions with respect to an axial direction of the crimp terminal 10 towards the connector portion 11 side and intersect at a central portion in a widthwise direction of the crimp terminal 10. At this time, the two weld trajectories 20*a* and 20*b* are formed to bulge towards the connector 11 side, but the weld trajectory is not formed on the crimp portion 12 side from the right and left end portions with respect to an axial direction of the crimp terminal 10 where the welding starts.

A terminal end (one end portion) of each of the weld trajectories 20*a* and 20*b* is deviated towards the connector portion 11 side with respect to the sealing portion 20 formed of the weld trajectories 20*a* and 20*b*.

In this case, an effect similar to that of the sealing portion 18 of FIG. 10A can also be achieved.

Figure 11C:
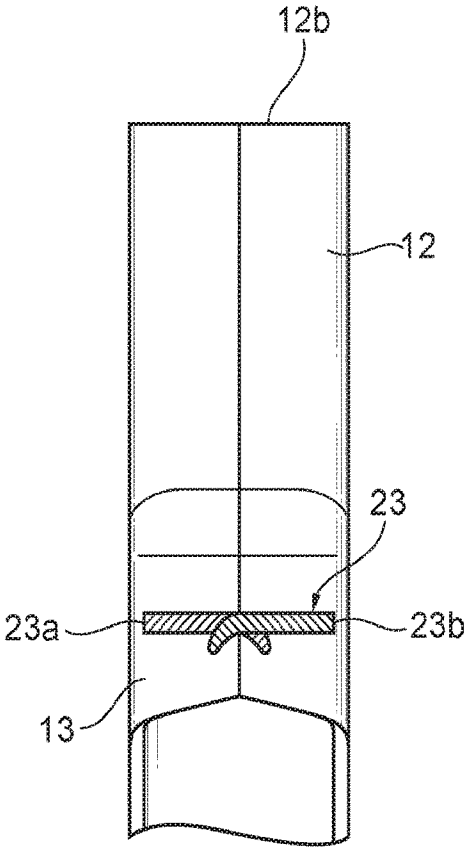
FIGS. 11A to 11C are plan views showing other variants of the sealing portion of the crimp terminal of the present disclosure.
Figure 11B:
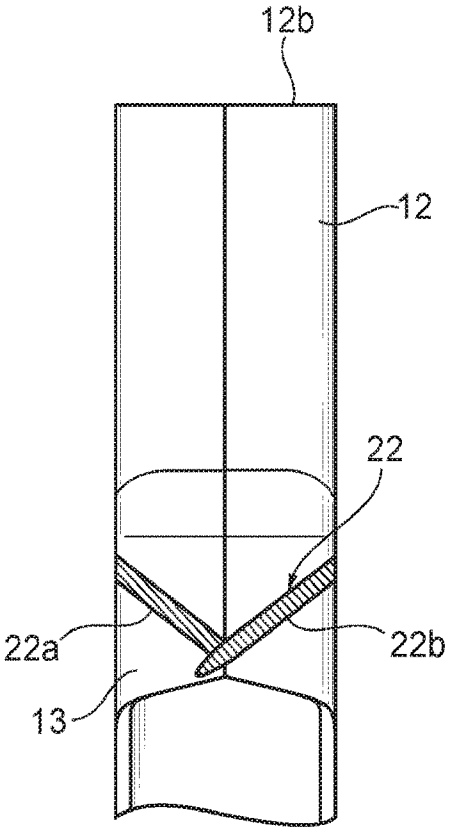
Figure 11A:
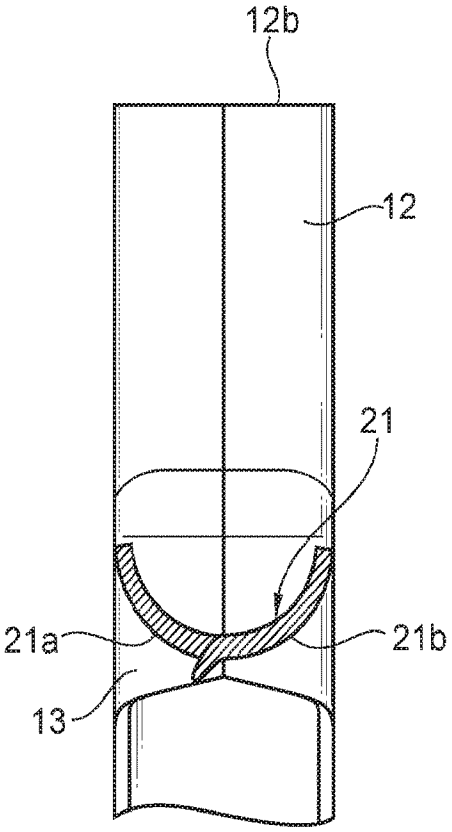
Figure 12:
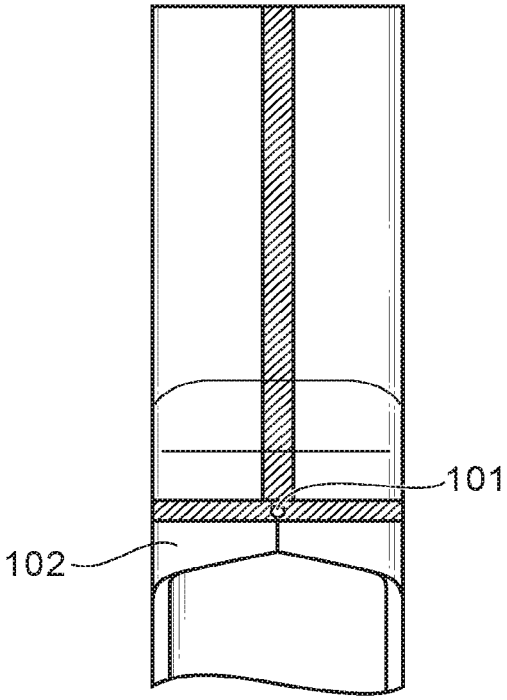
FIG. 12 is a plan view showing a problem in laser welding the overlapped portion of the conventional crimp terminal.

Further, as another variant, as shown in FIG. 11A, the sealing portion (weld trajectory) 21 at the overlapped portion 13 of the crimp terminal 10 is formed by two arc-shaped curved weld trajectories 21*a* and 21*b*. In this case, the sealing portion 21 is formed with two arc-shaped curved weld trajectories 21*a* and 21*b* to bulge from right and left end portions with respect to an axial direction of the crimp terminal 10 towards the connector portion 11 side. Here, a terminal end (one end portion) of one of the weld trajectories 21*b* is deviated towards the connector portion 11 side with respect to the arc-shaped weld trajectory.

Also, as another variant, as shown in FIG. 11B, a sealing portion (weld trajectory) 22 at the overlapped portion 13 of the crimp terminal 10 is formed in a V-shape with two linear weld trajectories 22*a* and 22*b*. In this case, the sealing portion 22 is formed from right and left end portions in an axial direction of the crimp terminal 10 and in a V-shape with two weld trajectories 22*a* and 22*b* such that a vertex is towards the connector 11 side. Here, a terminating end of one of the weld trajectories 22*b* (one end portion) is at a position deviated on the connector portion 11 side with respect to a V-shaped trajectory.

Also, as another variant, as shown in FIG. 11C, the sealing portion (weld trajectory) 23 in the overlapped portion 13 of the crimp terminal 10 is formed with two linear weld trajectories 23*a* and 23*b*. In this case, the sealing portion 23 is formed by drawing a straight line along a direction orthogonal to the axial direction of the crimp terminal 10 (a widthwise direction of the crimp terminal 10) such that the two linear weld trajectories 23*a* and 23*b* intersect at a central portion in a widthwise direction of the crimp terminal 10.

Here, a starting end of each of the weld trajectories 23*a* and 23*b* is at a position at a distance of less than a sheet thickness of the substrate forming the crimp terminal 10 from the one end and the other end of the overlapped portion 13, and the terminal end (one end portion) of each of the weld trajectories 23*a* and 23*b* is deviated to the connector portion 11 side with respect to the linear weld trajectory (sealing portion 23) formed by the weld trajectories 23*a* and 23*b*.

In this manner, by starting the welding of the sealing portion 23 not from the one end portion and the other end portion in the widthwise direction of the overlapped portion 13, but from a position at a distance of less than a sheet thickness of the crimp terminal 10, a metal portion (non-welded portion) that is still a substrate which is not welded remains at both end portions in the widthwise direction of the overlapped portion 13. Accordingly, such an unwelded portion functions as a frame, and the strength of the overlapped portion 13 is increased as compared to the case of continuously welding from the one end portion to the other end portion. Also, it is possible to omit the welding of a portion that does not need to be welded, and thus time required for the welding process can be shortened.

It is to be noted that also in the aforementioned variants, similarly to the first embodiment, an output power of the laser is decreased when sweeping the laser from the sealing portion 14 of each of the weld trajectories to a position deviated towards a side opposite to the crimp portion 12, so as to decrease a bead width of the welding trajectories.

Also, in the first embodiment and the second embodiment, the second weld trajectories 14*b* and 14*d* are formed after forming the first weld trajectories 14*a* and 14*c*, but the two weld trajectories 14*a*, 14*b*, 14*c* and 14*d* may be formed by welding simultaneously using two laser irradiation devices.

What is claimed is:

1. A crimp terminal comprising:

a crimp portion formed in a tubular shape with an electrically conductive substrate and configured to crimp join with an electric wire; and a sealing portion formed at one end of the crimp portion and seals against the electric wire to be crimp joined to the crimp portion, at the sealing portion, the substrate is bent and overlapped and continuously joined from one end portion to another end portion to form an overlapped portion in which an end portion of the crimp portion formed in the tubular shape is squeezed, a joining trajectory is formed at the sealing portion from a position at or adjacent to one side portion of the crimp terminal to a position at or adjacent to another side portion of the crimp terminal in a widthwise direction of the crimp terminal, the joining trajectory joins a top part of the overlapped portion to a bottom part of the overlapped portion, and one end of the joining trajectory is at a position that is deviated on a side opposite of the crimp portion with respect to the sealing portion.

2. The crimp terminal according to claim 1, wherein the joining trajectory of the sealing portion includes two joining trajectories, a first joining trajectory is formed continuously from the one end portion of the overlapped portion to a position between the one end portion and the other end portion, one end thereof being at a position that is deviated on a side opposite of the crimp portion with respect to the sealing portion, a second joining trajectory overlying the first joining trajectory continuously from the other end portion of the overlapped portion, one end thereof being at a position that is deviated on a side opposite of the crimp portion with respect to the sealing portion.

3. The crimp terminal according to claim 1, wherein the joining trajectory of the sealing portion includes two joining trajectories, a first joining trajectory is formed continuously from the one end portion of the overlapped portion to a position between the one end portion and the other end portion, a second joining trajectory overlying the first joining trajectory continuously from the other end portion of the overlapped portion, one end thereof being at a position that is deviated on a side opposite of the crimp portion with respect to the sealing portion.

4. The crimp terminal according to claim 1, wherein the joining trajectory is formed from the position at the one side portion of the crimp terminal to the position at the other side portion of the crimp terminal in the widthwise direction of the crimp terminal, and the joining trajectory is bent back to the one side portion continuously from the other side portion.

5. The crimp terminal according to claim 1, wherein a joining width of one end portion of the joining trajectory is smaller than a joining width of the joining trajectory at the sealing portion.

6. The crimp terminal according to claim 5, wherein a part of the joining trajectory at a position that is deviated on a side opposite of the crimp portion with respect to the sealing portion is smaller than a joining width of another part of the joining trajectory.

7. A connecting structure wherein the crimp terminal and the electric wire are connected at a crimp portion of the crimp terminal according claim 1.

8. A crimp terminal comprising:

a crimp portion formed in a tubular shape with an electrically conductive substrate and configured to crimp join with an electric wire; and a sealing portion formed at one end of the crimp portion and seals against the electric wire to be crimp joined to the crimp portion, at the sealing portion, an overlapped portion at which the substrate is bent and overlapped and joined, and in the overlapped portion, an end portion of the crimp portion formed in the tubular shape is squeezed, a joining trajectory is formed at the sealing portion from a position adjacent to one side portion of the crimp terminal to a position adjacent to another side portion of the crimp terminal in a widthwise direction of the crimp terminal, and a distance from each of the adjacent positions to the respective side portion of the crimp terminal is less than a sheet thickness of the substrate, the joining trajectory joins a top part of the overlapped portion to a bottom part of the overlapped portion, and one end of the joining trajectory is at a position that is deviated on a side opposite of the crimp portion with respect to the sealing portion.

9. The crimp terminal according to claim 8, wherein a joining width of one end portion of the joining trajectory is smaller than a joining width of the joining trajectory at the sealing portion.

10. The crimp terminal according to claim 9, wherein a part of the joining trajectory at a position that is deviated on a side opposite of the crimp portion with respect to the sealing portion is smaller than a joining width of another part of the joining trajectory.

* * * * *